US005385096A

United States Patent [19]

Suzuki

[11] Patent Number: 5,385,096

[45] Date of Patent: Jan. 31, 1995

[54] PRINTING PLATE CONTAMINANT REMOVING DEVICE FOR PRINTING PRESS

[75] Inventor: Hisaya Suzuki, Ebina, Japan

[73] Assignee: Dai Nippon Printing Co., Ltd., Tokyo, Japan

[21] Appl. No.: 136,548

[22] Filed: Oct. 14, 1993

[51] Int. Cl.[6] ..... B41F 35/00

[52] U.S. Cl. ..... 101/425; 15/256.52

[58] Field of Search ..... 101/423, 424, 425; 15/256.51, 256.52, 256.53; 355/299

[56] References Cited

U.S. PATENT DOCUMENTS

| | | | |
|---|---|---|---|
| 2,858,576 | 11/1958 | Rose | 15/256.52 |
| 3,759,220 | 9/1973 | Saito et al. | 101/425 |
| 4,499,827 | 2/1985 | Takeuchi et al. | 101/425 |
| 5,109,976 | 5/1992 | Mohri et al. | 15/256.52 |
| 5,208,639 | 5/1993 | Thayer et al. | 15/256.52 |
| 5,213,040 | 5/1993 | Mihori et al. | 101/425 |
| 5,255,606 | 10/1993 | Iijima et al. | 101/425 |

FOREIGN PATENT DOCUMENTS

| | | | |
|---|---|---|---|
| 57-56263 | 4/1982 | Japan . | |
| 59-174362 | 10/1984 | Japan . | |
| 63-4947 | 1/1988 | Japan | 101/425 |
| 0280250 | 3/1990 | Japan | 101/425 |

*Primary Examiner*—Ren Yan

*Attorney, Agent, or Firm*—Dvorak and Traub

[57] ABSTRACT

A contaminant removal head is disposed on a holder which is movable along a printing cylinder. The contaminant removal head includes a timing belt having a plurality of contaminant removal blades disposed at a predetermined pitch along the timing belt. The timing belt is rotatably disposed on a pair of spaced-apart timing pulleys driven by a motor that intermittently rotates the timing belt. A control unit controls the motor to position one of the contaminant removal blades adjacent the printing cylinder to remove contaminants therefrom. After contaminants have been removed from the printing cylinder, the motor rotates the timing belt to position a portion of the timing belt between adjacent contaminant removal blades adjacent the printing cylinder.

14 Claims, 4 Drawing Sheets

PRINTING PLATE CONTAMINANT REMOVING DEVICE FOR PRINTING PRESS

BACK GROUND OF THE INVENTION

1. Field of the Invention

The present invention relates to a novel printing plate contaminant removing device for removing ink residue, paper particles and other contaminants attached to a printing plate of a printing press.

2. Description of the Background Art

In the printing operation of various printing presses, ink residue, paper particles and other contaminants often become attached to the printing plate. Contaminants on the printing plate may cause a defect in the form of a pinhole-like white spot on a printed product called a hickey. It is, therefore, necessary to remove any contaminants from the printing plate while printing or during an interval between adjacent printing cycles.

Heretofore, various contaminant removing devices have been proposed. For example, it has been suggested to move a holder supporting a rod-like blade along a guide member extending parallel to a printing cylinder to move the rod-like blade linearly toward the printing plate for removing contaminants thereon as disclosed in Japanese Patent Laid-Open Publication No. S57-56263. It has also been suggested to use a disk-like blade instead of the rod-like blade as disclosed in Japanese Patent Laid-Open Publication No. S59-174362.

In the contaminant removing device using the rod-like blade, however, the contaminant that has been removed by the blade remains attached to the blade, and therefore when the blade is again urged against the printing cylinder for removing the next contaminant, the contaminant remaining attached to the blade may be re-attached to the printing plate. To prevent this, frequent cleaning of the blade is necessary.

In the contaminant removing device using the disk-like blade re-attachment of contaminants on the printing plate may be overcome by rotating the blade through a predetermined angle after completion of each contaminant removal operation. In this case, however, a mechanism for moving the blade back and forth in the direction of the printing cylinder, a mechanism for causing intermittent rotation of the disk-like blade through a predetermined angle, and a mechanism for moving the blade along the guide member is required. These additional mechanisms complicate the structure of the contaminant removing device. There is therefore a demonstrated need for an advancement in the art of removing contaminants from printing plates.

SUMMARY OF THE INVENTION

It is an object of the present invention to provide a novel printing plate contaminant removing device.

It is another object of the invention to provide a novel printing plate contaminant removing device for a printing press having a simple structure that is easy to operate.

Accordingly, the present invention is directed toward a printing plate contaminant removing device for a printing press. The device comprises a guide member extending along a printing cylinder, a holder movable along the guide member and a contaminant removal head supported on the holder. The contaminant removal head has a rotatable timing belt with a plurality of contaminant removal blades disposed at a predetermined pitch thereon. A drive means intermittently rotates the timing belt under the control of a control unit to position one of the contaminant removal blades adjacent the printing cylinder during contaminant removal. After the contaminants have been removed from the cylinder the motor positions a portion of the timing belt between adjacent contaminant removal blades adjacent to the printing cylinder.

According to the invention, the contaminant removal operation is performed when one of the contaminant removal blades is positioned adjacent the printing cylinder, and otherwise a portion of the movable member without any contaminant removal blade is positioned adjacent the printing plate.

These and other objects, features and advantages of the present invention will become apparent upon consideration of the following Detailed Description of the Invention with the accompanying drawings.

BRIEF DESCRIPTION OF THE DRAWINGS

The present invention will be more fully understood from the detailed description given below and from the accompanying drawings which should not be taken to be a limitation on the invention, but for explanation and understanding only.

In the drawings.

DESCRIPTION OF THE PREFERRED EMBODIMENT

Figure 1:
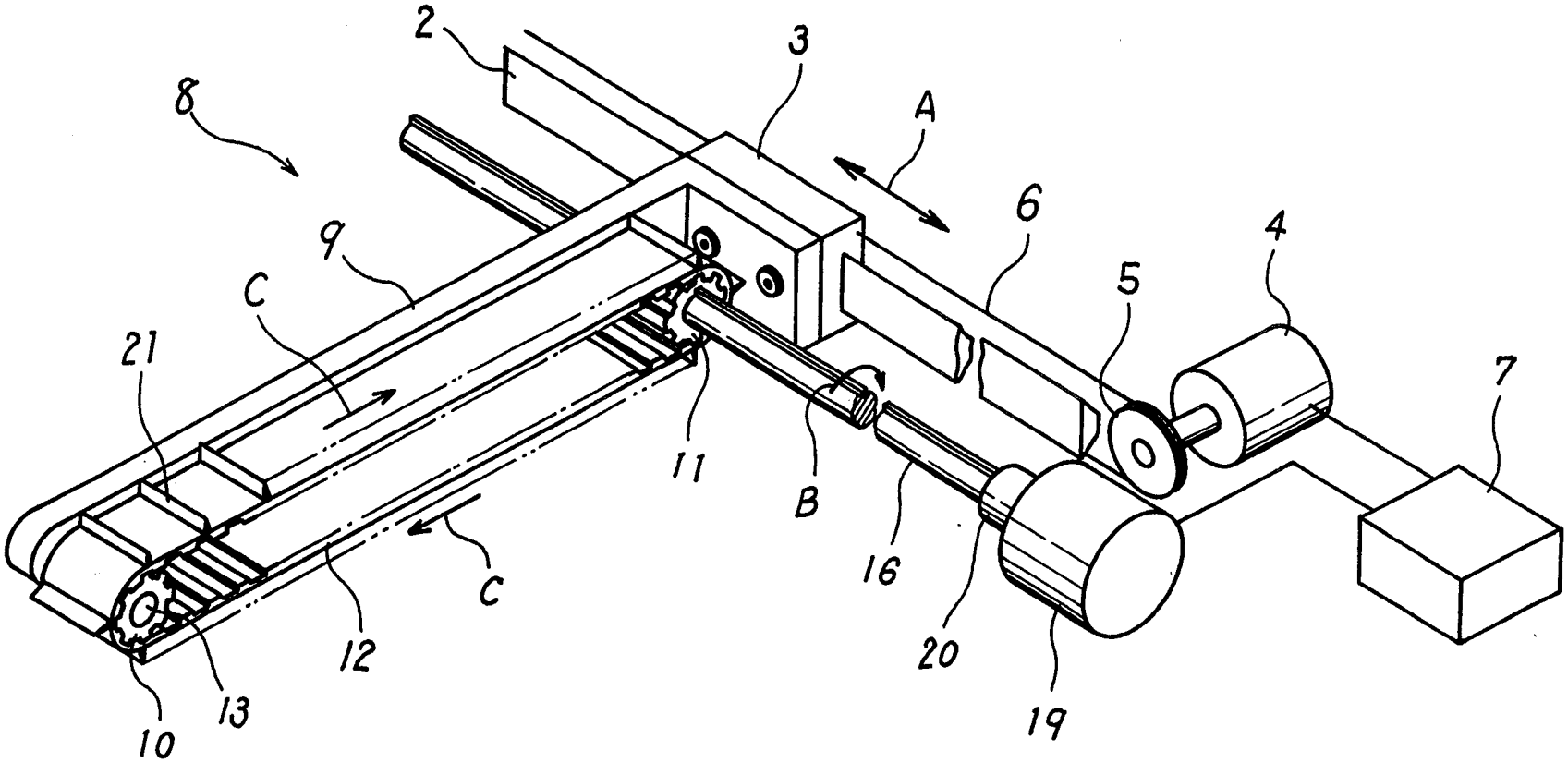
FIG. 1 is a perspective view of an embodiment of the invention.

FIG. 1 is a perspective view of a novel printing plate contaminant removing device generally comprising a contaminant removal head 8 disposed on a slider 3 supported by a stationary guide rail 2 that extends parallel to an axial direction of a rotating printing cylinder 1, and along the entire length thereof. The slider 3 may be moved along the guide rail 2 in the direction of arrows A by a wire 6 having ends secured to the slider 3. The wire 6 may be moved upon rotation of a pulley 5 driven by a motor 4. When a contaminant removal position is designated by operation of a contaminant removal position designation key (not shown), a control unit 7 actuates the motor 4 to move the slider 3 along the guide rail 2 to position the slider 3 adjacent to a contaminated portion of the printing cylinder 1.

Figure 2:
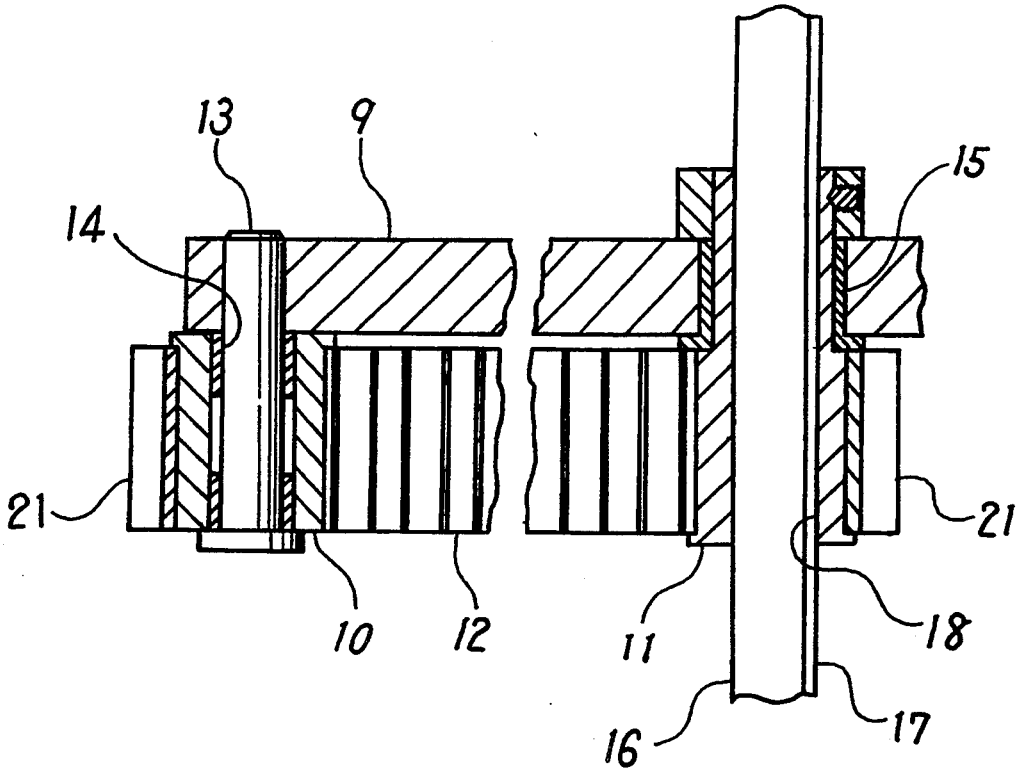
FIG. 2 is a fragmentary sectional view of FIG. 1.

The contaminant removal head 8 includes a timing belt 12 rotatably disposed on two timing pulleys 10 and 11 supported in a holder 9 so that axes of rotation of the timing pulleys 10 and 11 are parallel to the axial direction of the printing cylinder 1. The holder 9 is fixedly disposed on the slider 3. FIG. 2 is a sectional view of the two pulleys 10 and 11. The timing pulleys 10, disposed nearest the printing cylinder 1, is rotatably supported by a bearing 14 disposed on a pin 13 fixed to the holder 9. The timing pulley 11 is rotatably supported by a bearing 15 in the holder 9. A drive shaft 16 extending along the guide rail 2 penetrates the timing pulley 11. The drive shaft 16 has a key 17 extending substantially over its entire length, and the timing pulley 11 has a key groove 18 which is meshed with the key 17 of the drive shaft 16. When the holder 9 is moved in unison with the slider 3 along the guide rail 2, the timing pulley 11 is moved axially relative to the drive shaft 16 with the key 17 and key groove 18 in mesh with each other. The drive shaft 16 is coupled to a motor 19 by a shaft joint 20, which is controlled by a control unit 7. The motor 19 intermittently rotates the drive shaft 16 in the direction of arrow B and the rotation is intermittently transmitted to the timing pulley 11 by the key 17 and key groove 18.

The timing belt 12 has a plurality of contaminant removal blades 21 which are provided at a uniform pitch along the timing belt 12. The timing belt 12 is passed round the timing pulleys 10 and 11 so that the contaminant removal blades 21 are disposed on the outer side. The timing belt 12 is moved intermittently in the direction of arrow C by the intermittent rotation of the timing pulleys 10 and 11.

Figure 3A:
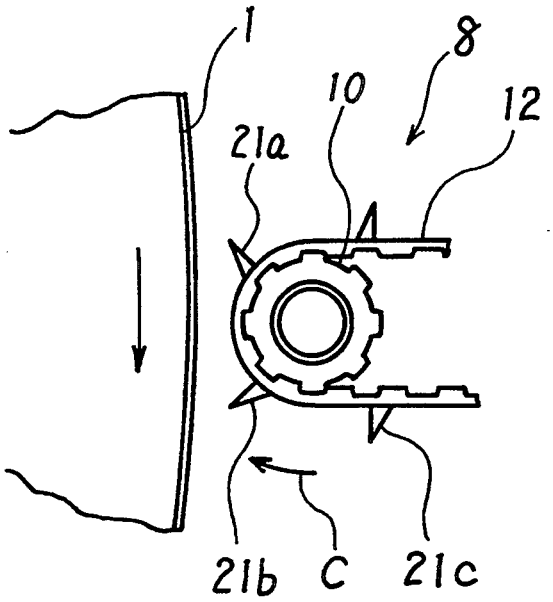
FIGS. 3(*a*) and 3(*b*) are fragmentary elevational views showing the positional relation between contaminant removal blades and a printing cylinder.
Figure 3B:
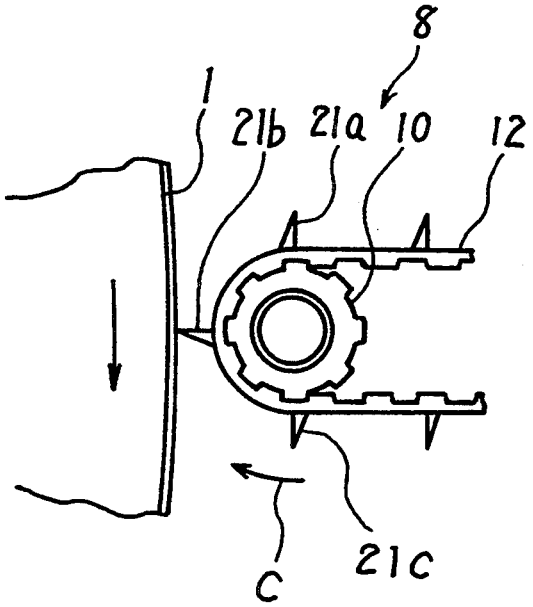

The control unit 7 also controls the motor 19 so that the timing belt 12 assumes either one of two positions. The first position is a waiting position, in which a portion of the belt between adjacent contaminant removal blades 21 is adjacent the printing cylinder 1 as shown in FIG. 3(*a*). The second position is an operative position, in which one of the contaminant removal blades 21 faces the printing cylinder i as shown in FIG. 3(*b*). The operation times of the two motors 4 and 19 are adjusted so that the timing belt 12 is held in the waiting position while the motor 4 is driven to move the slider 3 to a position designated by a contaminant removal position designation key (not shown). The timing belt 12 is brought to the operative position after the slider 3 has been moved to the designated position. The motor 19 is also controlled so that the timing belt 12 is brought to the waiting position after a timed interval after the setting of a contaminant removal blade 21 to the operative position.

When an operator finds a defect on printed matter, the contaminant removing device is positioned adjacent to the portion of the printing cylinder having the defect by means of a contaminant removal position designation key (not shown). In response to the position designation key, the control unit 7 actuates the motor 4 to move the slider 3 to the designated position. During this movement, the timing belt 12 is held in the waiting position as shown in FIG. 3(*a*).

When the slider 3 has been brought to the designated position, the control unit 7 then actuates the motor 19 to bring the contaminant removal blade **21*b*** to the operative position as shown in FIG. 3(*b*). While the contaminant removal blade **21*b* is urged against the printing cylinder 1, the contaminant removal blade 21*b* removes the contaminant attached to the printing plate as the printing cylinder 1 rotates. After a timed interval, the motor 19 is again actuated to bring the timing belt 12 to the waiting state. The timing belt 12 is moved by one pitch in the direction of arrow C. So that the contaminant removal blade 21*b* with an attached contaminant escapes upward, and a new contaminant removal blade 21*c* is brought to the waiting position. When another defect is detected , a new position is designated by the contaminant removal position designation key, the slider 3 is moved to that position, and then the new contaminant removal blade 21*c* is brought to the operative position, whereby the contaminant is removed by the contaminant removal blade 21*c***.

In the embodiment described the moving mechanism 4 for moving the contaminant removal blades 21 along the printing cylinder i and the driving mechanism 19 for intermittently rotating the timing belt 12 are the only requirements for removing contaminants from the printing cylinder. In the prior art structure, however, a moving mechanism, a back-and-forth drive mechanism and a rotational drive mechanism are required to remove contaminants from the printing cylinder. In addition, since the timing belt 12 of the present invention is provided with a plurality of contaminant removal blades 21, it is possible to eliminate re-attachment of the previously removed contaminant to the printing plate in subsequent contaminant removal operations. Further, the present invention reduces the number of operation cycles associated with cleaning the blades 21 by providing as many contaminant removal blades 21 as possible.

The contaminant that is attached to the contaminant removal blade 21 may be removed by a cleaner (not shown) with the contaminant removal blade 21 brought to a position on the excursion orbit of the timing belt 12 that is spaced apart from the printing cylinder 1 so that the timing belt 12 may be used continuously. Alternatively, instead of providing the cleaner for removing the contaminant attached to the contaminant removal blade 21, it is possible to replace the timing belt 12 with a new timing belt after all the contaminant removal blades 21 have been used for the contaminant removal operation.

Figure 4:
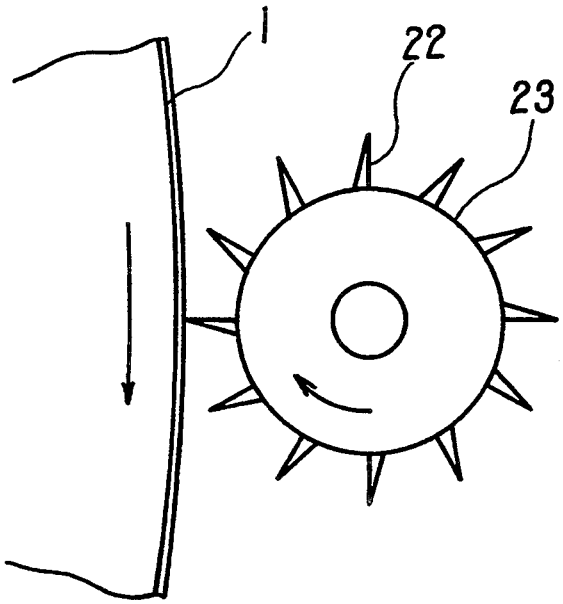
FIG. 4 is a fragmentary elevational view of a modification of the embodiment of FIG. 1.

In the above embodiment, the movable member has been formed by the pair pulleys 10 and 11 and the timing belt 12 passed therearound. However, as an alternative, as shown in FIG. 4, a rotary drum 23 having contaminant removal blades 22 provided on the outer periphery at a predetermined pitch may be provided along printing cylinder i so that the rotary drum 23 is movable in the axial direction of the printing cylinder i and intermittently rotatable about its own axis to a waiting position and an operative position as described above.

As a further alternative, in lieu of the movable member capable of excursion, a straight-moving beam having a plurality of contaminant removal blades provided on a front surface at a predetermined pitch, may be provided such that it faces the printing cylinder and is movable in the axial direction of the printing cylinder as well as being intermittently movable in a direction normal to the axis of the printing cylinder to a waiting position and an operative position as described above.

Although the invention has been illustrated and described with respect to several exemplary embodiment thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A printing plate contaminant removing device for removing contaminants frown a printing cylinder rotatable about a cylinder axis, the device comprising:

a guide member extending substantially parallel to the cylinder axis;

a holder disposed on and movable along the guide member;

a rotatable belt with a plurality of contaminant removal blades disposed at intervals along the belt at a predetermined pitch;

first drive means for driving the rotatable belt;

a pair of pulleys journaled to the holder and rotatably engaged to the rotatable belt, wherein the first drive means positions one of the contaminant removal blades adjacent to and in contact with the printing cylinder to remove contaminants from the printing cylinder, and the first drive means positions the contaminant removal blades away from the printing cylinder wherein none of the contaminant removal blades contact the printing cylinder when contaminants are not being removed from the printing cylinder.

2. The device of claim 1 further comprising a second drive means for moving the holder along the guide member, wherein the second drive means positions the holder in relation to the printing cylinder.

3. The device of claim 2 wherein the device further comprises a slider slidably coupling the holder to the guide member and wherein the second drive means comprises a motor driven pulley rotatably coupled to a wire connected to the slider whereby the motor driven pulley may move the slider and the holder along the guide member.

4. The device of claim 3 further comprising control means for controlling the first drive means, and for controlling the second drive means.

5. The device of claim 4 wherein the first drive means comprises a motor driven shaft coupled to one of the pulleys rotatably, engaged to the rotatable belt.

6. The device of claim 5 wherein the motor driven shaft coupled to one of the pulleys is coupled by a key disposed in a groove in the pulley, and wherein the other pulley is rotatably disposed on a pin disposed in the holder.

7. A printing plate contaminant removing device for removing contaminants from a printing cylinder rotatable about a cylinder axis, the device comprising:

a guide member extending substantially parallel to the cylinder axis, and fixed in relation to the printing cylinder;

a holder disposed on and movable along the guide member;

a contaminant removal head supported by the holder, the contaminant removal head having a plurality of contaminant removal blades disposed at spaced intervals thereon, wherein the contaminant removal blades are movable about an axis parallel to the cylinder axis;

first drive means for positioning one of the contaminant removal blades adjacent to and in contact with the printing cylinder to remove a contaminant from the printing cylinder, and positioning the contaminant removal blades away from the printing cylinder wherein none of the contaminant removal blades contact the printing cylinder when contaminants are not being removed from the printing cylinder.

8. The device of claim 7 wherein the contaminant removal blades are disposed at spaced intervals about a rotatable drum at a predetermined pitch.

9. The device of claim 8 further comprising a second drive means for moving the holder along the guide member, wherein the second drive means positions the contaminant removal head in relation to the printing cylinder.

10. The device of claim 9, wherein the device further comprises a slider slidably coupling the holder to the guide member and wherein the second drive means comprises a motor driven pulley rotatably coupled to a wire connected to the slider whereby the motor driven pulley may move the slider find the holder along the guide member.

11. The device of claim 10 further comprising control means for controlling the first drive means, and for controlling the second drive means.

12. A method for removing a contaminant from a printing cylinder rotatable about a cylinder axis, the method comprising the steps of:

providing a guide member fixed in relation to the printing cylinder;

positioning a holder slidably on said guide member;

positioning a contaminant removal head movably on the holder, the contaminant removal head having a plurality of contaminant removal blades disposed at a predetermined pitch, so that one of the contaminant removal blades is disposed adjacent to and in contact with the printing cylinder;

rotating the printing cylinder wherein the contaminant removal blade adjacent to and in contact with the rotating printing cylinder removes the contaminant therefrom; and positioning the contaminant removal head so that none of the plurality of contaminant removal blades are disposed adjacent to and in contact with the rotating printing cylinder when contaminants are not being removed from the rotatable printing cylinder.

13. The method of claim 12 further comprising a step of positioning the contaminant removal head in relation to the rotating printing cylinder by positioning the holder along the guide member when none of the plurality of contaminant removal blades are disposed adjacent to and in contact with the rotating printing cylinder.

14. A method for removing contaminants from a printing cylinder rotatable about a cylinder axis, the method comprising:

providing a guide member fixed in relation to the printing cylinder;

positioning a holder slidably on said guide member;

positioning a rotatable belt being movably disposed on the holder and having a plurality of contaminant removal blades disposed at intervals along the rotatable belt at a predetermined pitch, wherein one of the contaminant removal blades is positioned adjacent to and in contact with the printing cylinder;

rotating the printing cylinder wherein the contaminant removal blade adjacent to and in contact with the rotating printing cylinder removes contaminants therefrom; and positioning the rotatable belt so that the contaminant removal blade is moved away from the printing cylinder and none of the contaminant removal blades contact the printing cylinder when contaminants are not being removed from the printing cylinder.

* * * * *